US011338602B2

(12) United States Patent
Shih

(10) Patent No.: US 11,338,602 B2
(45) Date of Patent: May 24, 2022

(54) HANDLE ASSEMBLY FOR A STAMP

(71) Applicant: SUN SAME ENTERPRISES CO., LTD., Tainan (TW)

(72) Inventor: Wen-Jer Shih, Tainan (TW)

(73) Assignee: SUN SAME ENTERPRISES CO., LTD., Tainan (TW)

( * ) Notice: Subject to any disclaimer, the term of this patent is extended or adjusted under 35 U.S.C. 154(b) by 372 days.

(21) Appl. No.: 16/507,929

(22) Filed: Jul. 10, 2019

(65) Prior Publication Data

US 2020/0353764 A1 Nov. 12, 2020

(30) Foreign Application Priority Data

May 8, 2019 (TW) ..... 108205670

(51) Int. Cl.
*B41K 1/56* (2006.01)
*B41K 1/40* (2006.01)

(52) U.S. Cl.
CPC . *B41K 1/56* (2013.01); *B41K 1/40* (2013.01)

(58) Field of Classification Search
CPC ..... B41K 1/40; B41K 1/56; G03G 21/1614; Y10S 16/12; Y10S 16/24; Y10S 16/25; Y10S 16/30
See application file for complete search history.

(56) References Cited

U.S. PATENT DOCUMENTS 4,837,892 A * 6/1989 Lo ..... B25F 5/006 16/431
2005/0155504 A1* 7/2005 Shih ..... B41K 1/02 101/333
2012/0150216 A1* 6/2012 Hickingbotham ..... A61B 17/30 606/206

* cited by examiner

*Primary Examiner* — Jennifer Bahls
*Assistant Examiner* — Quang X Nguyen
(74) *Attorney, Agent, or Firm* — Rabin & Berdo, P.C.

(57) ABSTRACT

A handle assembly adapted to be mounted on a driving member of a stamp has a knob body and an extending portion. The knob body has a bowl-shaped head, a central post, and a fixing seat. The extending portion has a ball joint, a collar, and a fixing plate. The ball joint is engaged with and encloses the bowl-shaped head, the collar surrounds the central post, and the fixing plate is mounted in a slot of the fixing seat. The extending handle is mounted on a top of the knob body firmly by the engagement between the ball joint and the bowl-shaped head.

12 Claims, 8 Drawing Sheets

HANDLE ASSEMBLY FOR A STAMP

BACKGROUND OF THE INVENTION

1. Field of the Invention

The present invention relates to a stamp, and more particularly to a handle assembly for a stamp, which has an extending handle.

2. Description of Related Art

With reference to FIG. 8, a conventional self-inking stamp has a handle knob 90 and a stamp block 80. The user spherically grips on the top of the handle knob 90 and presses downward with one palm, and a stamping surface of the stamp block 80 that faces upward and contacts an ink pad is turned down and is pressed to stamp on the document. However, when the user grasps on the top of the handle knob 90, an angle nearly 90 degrees is formed between the palm and the arm. For performing a good stamping, the user will habitually press the handle knob 90 with a strong force, which will impact the wrist of the user, and the wrist will be prone to injury. In particular, the workers who need to operate the stamp continuously are at higher risk of wrist injuries.

To prevent the wrist injuries, a prolonged stamp handle is provided in the market, so the user can grasp on the stamp handle on the lateral area of the cylindrical stamp handle. The conventional stamp handle has a knob body, a top cap, and an optional extending handle. The knob body has a hook protruding from the top thereof. The top cap is mounted on the top of the knob body and is engaged with the hook of the knob body. The extending handle has a slot formed at the bottom thereof and engaged with the hook of the knob body. The user can assemble the top cap or the extending handle on the top of the knob body depending on demand. When the extending handle is mounted on the top of the knob body, the holding area of the stamp handle is increased, and the user can stamp by grasping on the lateral area of the stamp handle. However, when the top cap is mounted on the knob body, the user will press the stamp by spherically gripping on the top cap with the palm, so the connection between the top cap and the knob body will not cause concerns. However, when the extending handle is mounted on the knob body, the user will press the stamp by grasping on the lateral area of the extending handle. The slot of the extending handle and the hook of the knob body are unfirmly engaged with each other, and will be detached easily by a large pressing force or a deviated pressing force to increase the risk of injuries.

To overcome the shortcomings, the present invention tends to provide a handle assembly for a stamp to mitigate or obviate the aforementioned problems.

SUMMARY OF THE INVENTION

The main objective of the invention is to provide a handle assembly for a stamp having a knob body and an extending handle mounted with each other stably to ensure the operational safety.

A handle assembly adapted to be mounted on a driving member of a stamp has a knob body and an extending handle. The knob body is mounted on a top of the driving member and has a bowl-shaped head, a central post, and a fixing seat. The bowl-shaped head is formed on a top of the knob body and is hemispherical in shape, and has an opening formed in a top of the bowl-shaped head, an outer surface having a top end, and a cavity formed in the bowl-shaped head and communicating with the opening of the bowl-shaped head. The central post is formed on and protrudes upward from a bottom of the cavity of the bowl-shaped head and has a top end protruding from the top end of the outer surface of the bowl-shaped head. The fixing seat is held in the cavity of the bowl-shaped head, is located away from a side of the central post, and has a top end protruding from the top end of the outer surface of the bowl-shaped head and a slot formed in the fixing seat and having an opening on the top end of the fixing seat. The extending handle has a handle body, a ball joint, a collar, and a fixing plate. The handle body is formed on a top of the extending handle. The ball joint is formed on a bottom of the extending handle, is engaged with and encloses the bowl-shaped head of the knob body, is hollow, and has an opening formed in a bottom of the ball joint, a chamber formed in the ball joint and communicating with the opening of the ball joint, and an inner surface formed in the ball joint, corresponding to the outer surface of the bowl-shaped head in shape, and abutting the outer surface of the bowl-shaped head. The collar is formed on and extends downward from an inner top surface of the chamber of the ball joint, protrudes from the opening of the ball joint, and surrounds the central post of the knob body. The fixing plate is formed on and extends downward from the inner top surface of the chamber of the ball joint, protrudes from the opening of the ball joint, and is mounted in the slot of the fixing seat.

Other objects, advantages and novel features of the invention will become more apparent from the following detailed description when taken in conjunction with the accompanying drawings.

DETAILED DESCRIPTION OF PREFERRED EMBODIMENT

Figure 1:
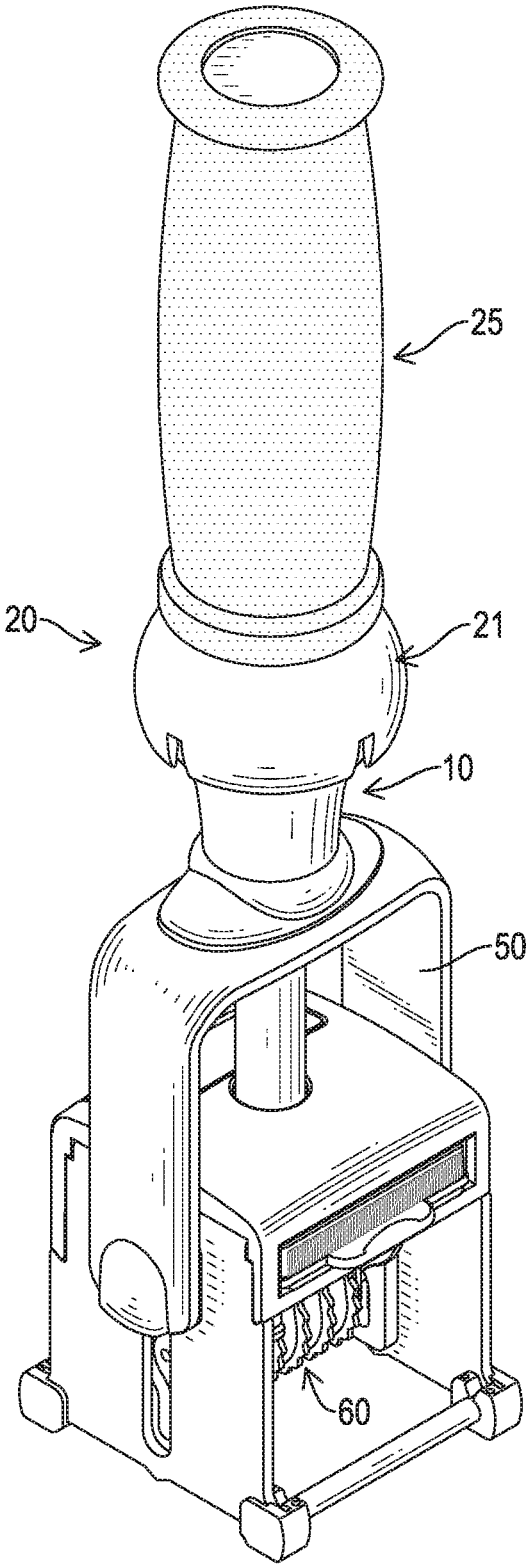
FIG. 1 is a perspective view of a stamp with a handle assembly in accordance with the present invention.
Figure 2:
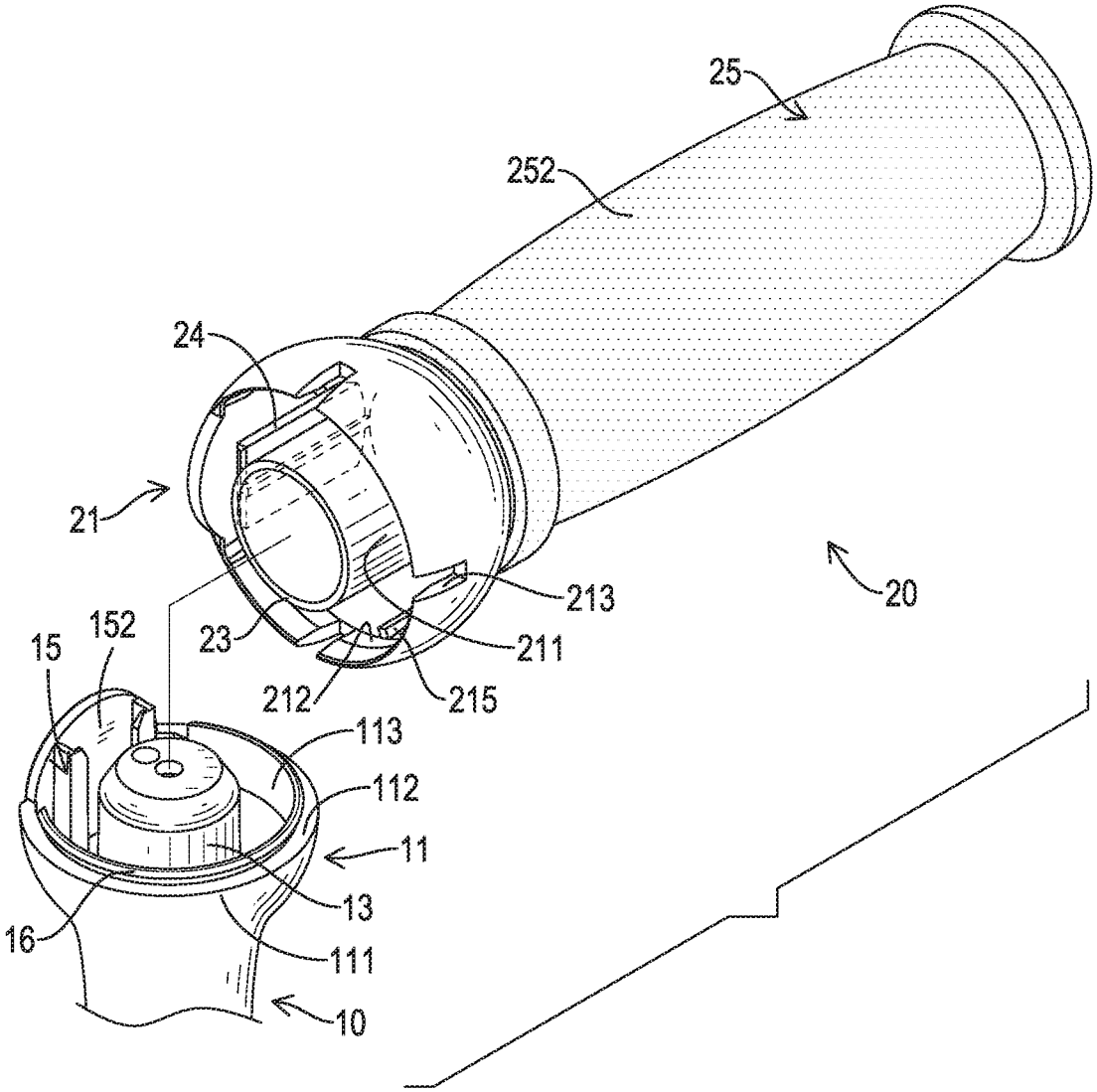
FIG. 2 is an enlarged exploded perspective view of the handle assembly in FIG. 1.
Figure 3:
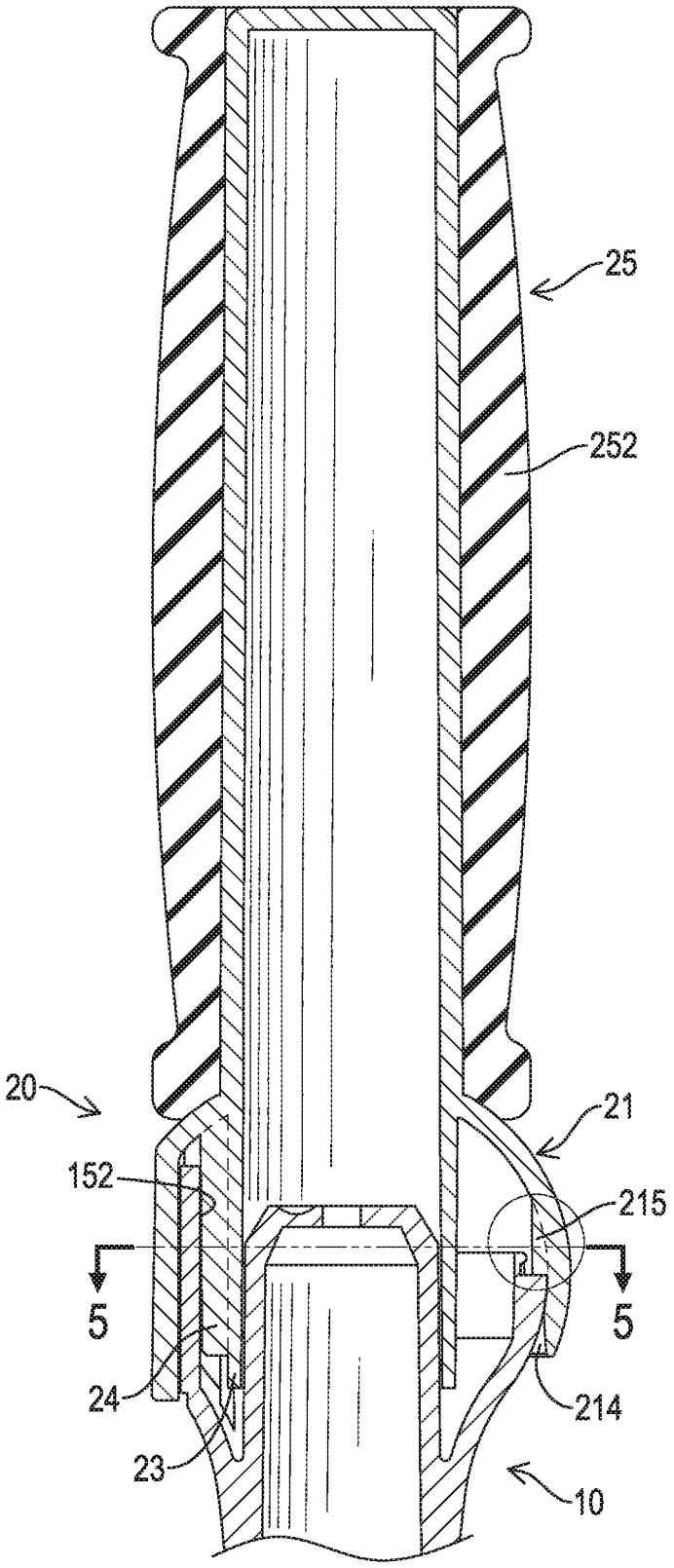
FIG. 3 is an enlarged cross sectional side view of the handle assembly in FIG. 1.
Figure 3A:
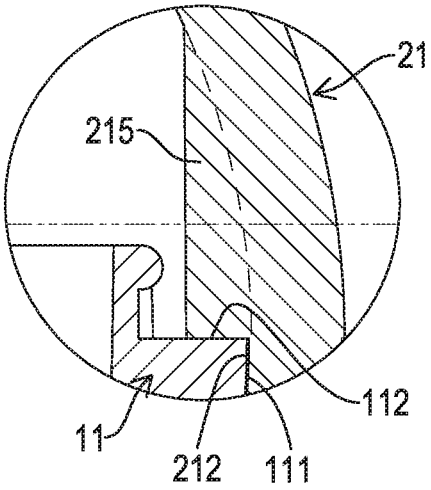
FIG. 3A is an enlarged cross sectional side view of the handle assembly in FIG. 3.
Figure 4:
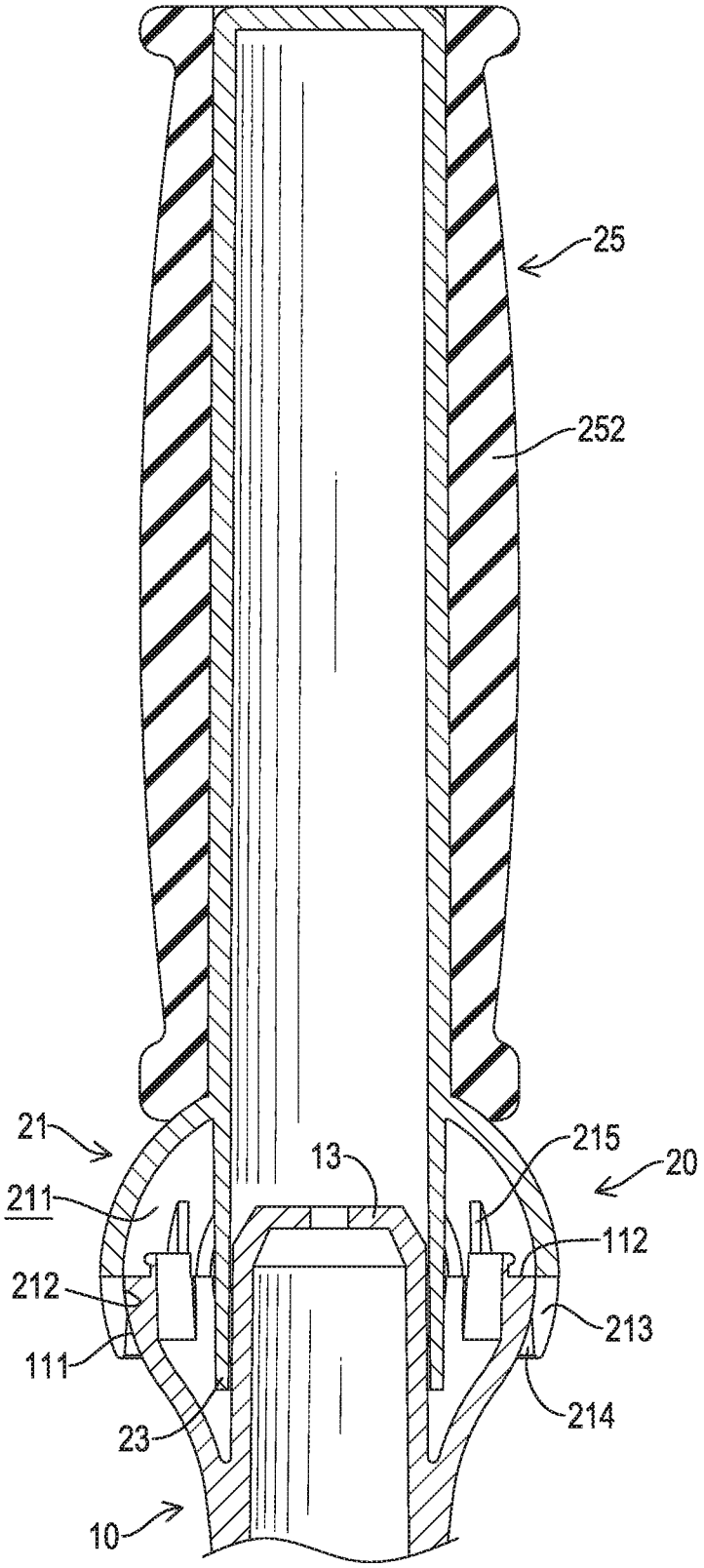
FIG. 4 is another enlarged cross sectional side view of the handle assembly in FIG. 1.
Figure 5:
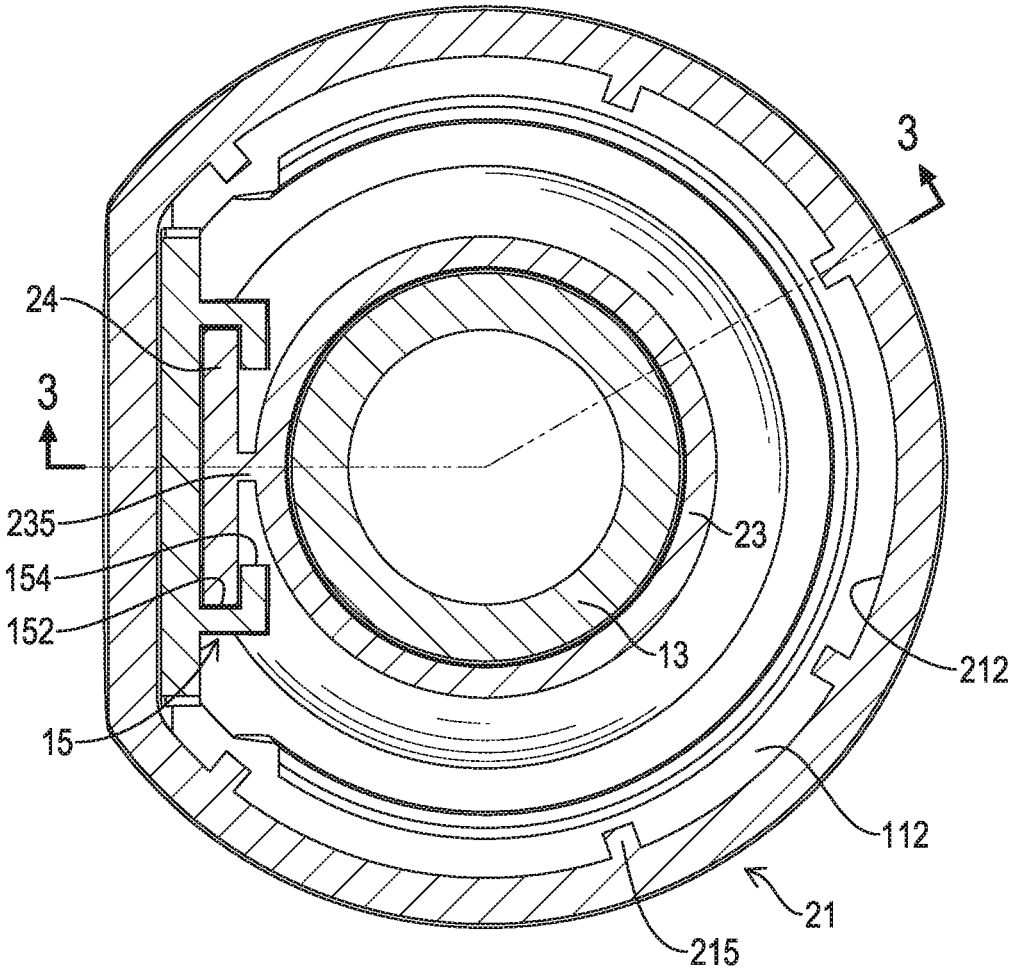
FIG. 5 is a cross sectional top view of the handle assembly along the line 5-5 in FIG. 3.
Figure 7:
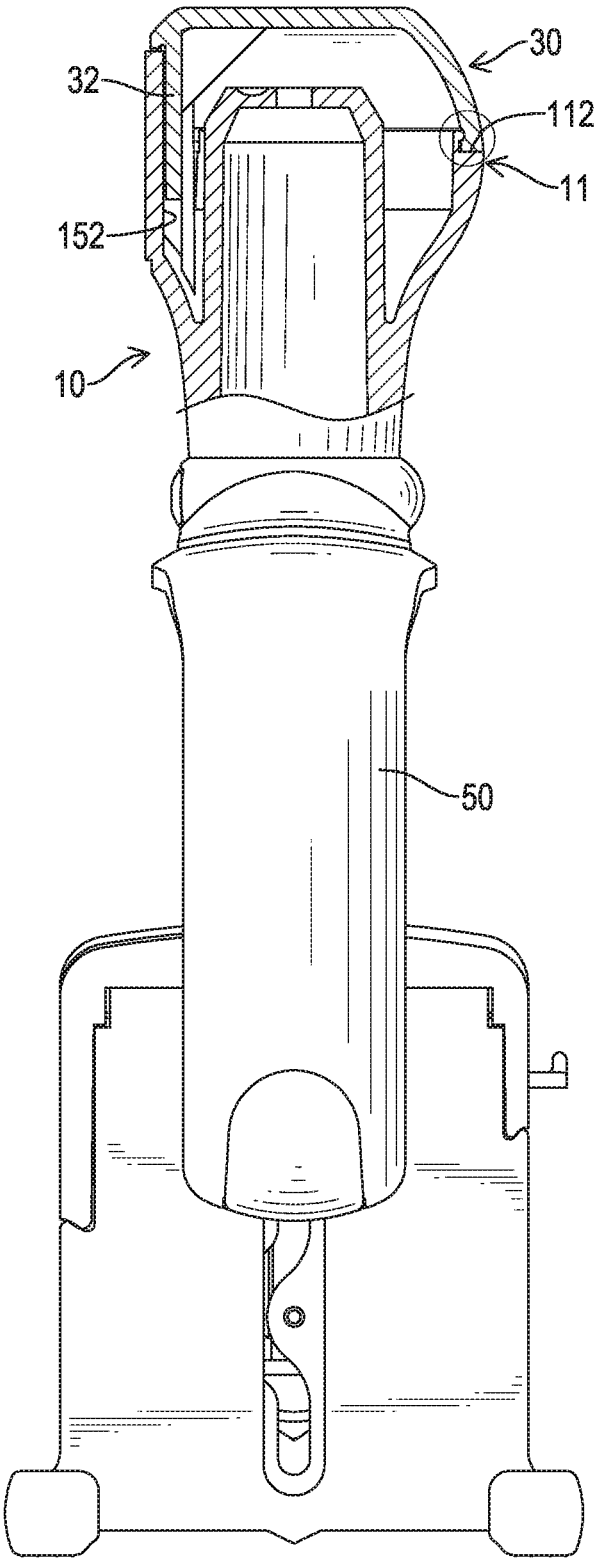
FIG. 7 is a side view in partial section of the knob body of the handle assembly in FIG. 1, showing an end cap mounted on the top of the knob body.
Figure 7A:
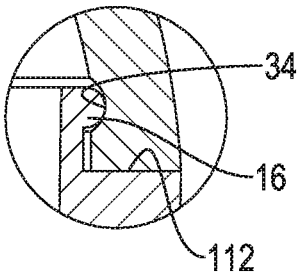
FIG. 7A is an enlarged cross sectional side view of the knob body of the handle assembly in FIG. 7.
Figure 8:
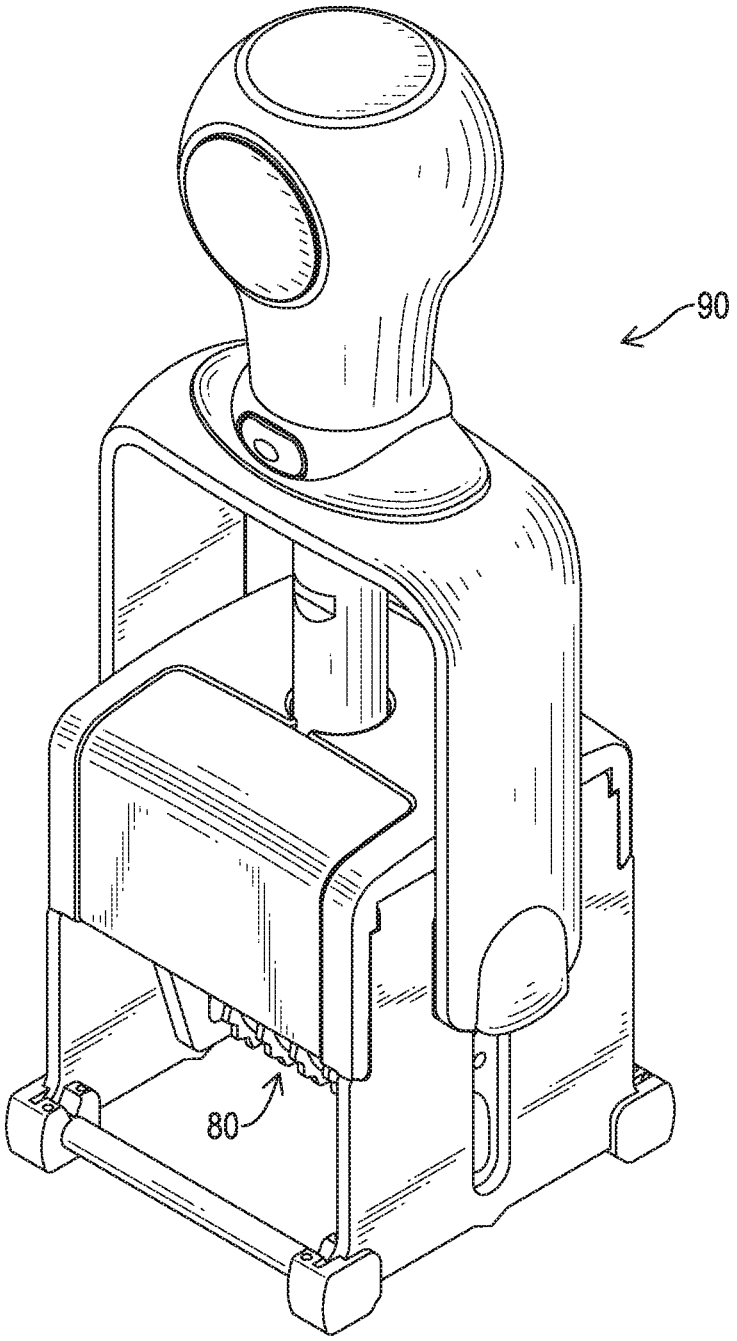
FIG.8 PRIOR ART
FIG. 8 is a perspective view of a conventional stamp.

With reference to FIGS. 1, 2, and 7, a handle assembly in accordance with the present invention is applied for being mounted on a driving member 50 of a stamp. The handle assembly has a knob body 10, an extending handle 20, and an end cap 30. The knob body 10 may be assembled with the extending handle 20 or the end cap 30.

With reference to FIGS. 1 and 2, the knob body 10 is mounted on a top of the driving member 50 of the stamp. The driving member 50 is connected to a stamp block 60 of the stamp, and drives the stamp block 60 to turn over and move down to stamp on a document. The knob body 10 may be an integrated plastic component, and has a bowl-shaped head 11, a central post 13, and a fixing seat 15.

With reference to FIGS. 2 to 5, the bowl-shaped head 11 is formed on a top of the knob body 10, is hemispherical in shape, and has an opening defined in the top of the bowl-shaped head 11. The bowl-shaped head 11 has an outer surface 111 and a cavity 113. The outer surface 111 is a hemispherical surface and has a top end 112. The cavity 113 is formed in the bowl-shaped head 11 and communicates with the opening of the bowl-shaped head 11.

The central post 13 is cylindrical in shape, is formed on and protrudes upward from a bottom of the cavity 113, and has a top end protruding from the top end 112 of the outer surface 111. The fixing seat 15 is held in the cavity 113, is located away from a side of the central post 13, and has a slot 152. The slot 152 is formed in the fixing seat 15, is spaced from the central post 13, and has a top opening. The top end of the fixing seat 15 protrudes from the top end 112 of the outer surface 111. The bowl-shaped head 11 may further have a hook portion 16. The hook portion 16 protrudes from the top end 112, is spaced from the outer surface 111, and has a protrusion facing the outer surface 111. With reference to FIG. 7, the end cap 30 is mounted on the top of the bowl-shaped head 11 to assemble with the knob body 10 as a short knob. The end cap 30 has an inserting plate 32 and a hook groove 34. The inserting plate 32 is mounted in the slot 152 of the fixing seat 15. The hook groove 34 is engaged with the protrusion of the hook portion 16.

With reference to FIGS. 2 to 5, the extending handle 20 is mounted on the top of the bowl-shaped head 11 to assemble with the knob body 10 as a long handle. The extending handle 20 has a handle body 25, a ball joint 21, a collar 23 and a fixing plate 24.

The handle body 25 is formed on the top of the extending handle 20 and is elongated. The handle body 25 may have a cushion 252 mounted around the handle body 25 and completely or partially covering a periphery of the handle body 25 to provide a good holding feel.

The ball joint 21 is formed on the bottom of the extending handle 20, is engaged with the bowl-shaped head 11, encloses the outer surface 111 of the bowl-shaped head 11, is formed as a hollow ball having an opening on the bottom, and has a chamber 211 and an inner surface 212. The chamber 211 is formed in the ball joint 21 and communicates with the opening of the ball joint 21. The inner surface 212 is formed in the ball joint 21, corresponds to the outer surface 111 in shape and abuts the outer surface 111 of the bowl-shaped head 11. Preferably, the ball joint 21 has multiple slits 213, a chamfer 214, and multiple abutting ribs 215. The slits 213 are formed in the bottom of the ball joint 21 and are arranged around the ball joint 21 at angular intervals. The chamfer 214 is formed around the edge of the chamber 211 such that the opening of the ball joint 21 has a diameter gradually larger downward. The abutting ribs 215 are formed on an inner surface of the chamber 211, are arranged at angular intervals, and are disposed at positions corresponding to the top end 112 of the outer surface 111 of the bowl-shaped head 11, and abut the top end 112 of the outer surface 111 to limit an assembling position between the ball joint 21 and the bowl-shaped head 11. Thus, the ball joint 21 can be connected with the bowl-shaped head 11 easily.

The collar 23 is formed on and extends downward from an inner top surface of the chamber 211, protrudes from the opening of the ball joint 21, and surrounds the central post 13. The fixing plate 24 is formed as a slice, is formed on and extends downward from the inner top surface of the chamber 211, protrudes from the opening of the ball joint 21, and is mounted in the slot 152 of the fixing seat 15. Preferably, a connecting rib 235 is formed between and connects the collar 23 and the fixing plate 24 to increase the structural strength of the collar 23 and the fixing plate 24. The fixing seat 15 has a notch defined in the fixing seat 15 at a position corresponding to the connecting rib 235, and the connecting rib 235 can be held in the notch.

The knob body 10 is easily assembled with and detached from the extending handle 20 or the end cap 30. The extending handle 20 can be replaced with the end cap 30 to mount on the knob body 10 when needed. The engagement between the top cap 30 and the knob body 10 is released easily. When assembling the extending handle 20 with the knob body 10, the extending handle 20 is pressed downward to plug the central post 13 into the collar 23 and the fixing plate 24 into the slot 152, and to enclose the bowl-shaped head 11 with the ball joint 21. Accordingly, the extending handle 20 can be mounted on the knob body 10 stably. To detach the extending handle 20 from the knob body 10, the extending handle 20 is pulled upward to release the engagement between the ball joint 21 and the bowl-shaped head 11. After that, the top cap 30 is mounted on the top of the knob body 10 to reduce the storage space for the stamp.

Figure 6:
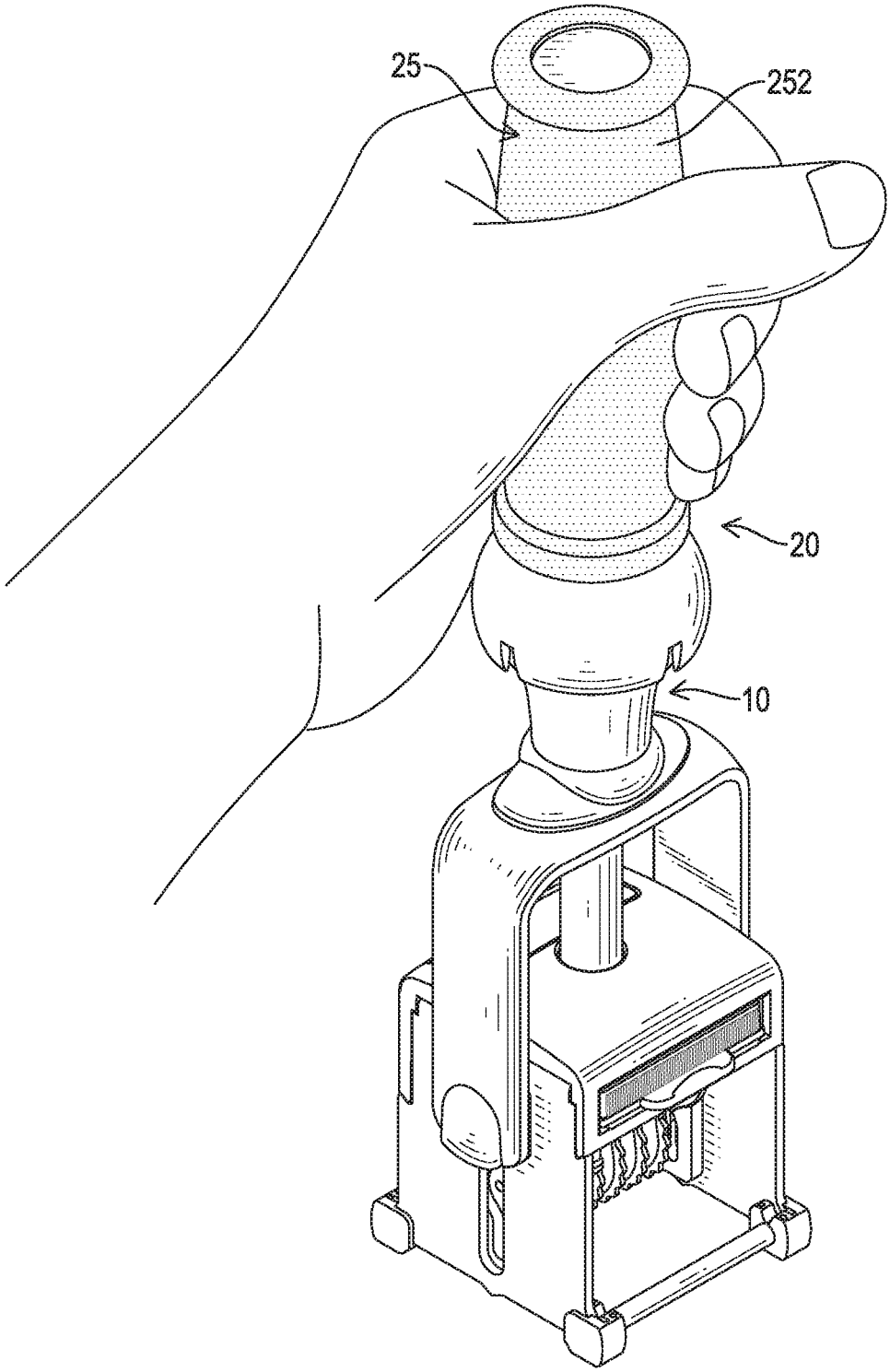
FIG. 6 is an operational perspective view of the handle assembly in FIG. 1.

The extending handle 20 and the knob body 10 are connected with each other by the engagement of the ball joint 21 and the bowl-shaped head 11 with spherical curved surfaces. Moreover, the collar 23 surrounding the central post 13 and the fixing plate 24 inserted in the slot 152 are formed as a clamped plug combination. Thus, the extending handle 20 is mounted on the top of the knob body 10 stably. The user can grasp on the lateral outer surface of the handle body 25, as shown on FIG. 6, to prevent the wrist injuries when pressing the stamp with a strong force or operating the stamp continuously. The operation safety of the stamp can be ensured. The movement of pressing the stamp is smooth with firm connection of the extending handle 20 and the knob body 10.

What is claimed is:

1. A handle assembly adapted to be mounted on a driving member of a stamp and comprising:

a knob body having a bowl-shaped head formed on a top of the knob body and being hemispherical in shape, and having an opening formed in a top of the bowl-shaped head;

an outer surface having a top end; and a cavity formed in the bowl-shaped head and communicating with the opening of the bowl-shaped head;

a central post formed on and protruding upward from a bottom of the cavity of the bowl-shaped head and having a top end protruding from the top end of the outer surface of the bowl-shaped head; and a fixing seat held in the cavity of the bowl-shaped head, located away from a side of the central post, and having a top end protruding from the top end of the outer surface of the bowl-shaped head; and a slot formed in the fixing seat of the bowl-shaped head and having an opening on the top end of the fixing seat; and an extending handle having a handle body formed on a top of the extending handle;

a ball joint formed on a bottom of the extending handle, engaged with and enclosing the bowl-shaped head of the knob body, being hollow, and having an opening formed in a bottom of the ball joint;

a chamber formed in the ball joint and communicating with the opening of the ball joint; and an inner surface formed in the ball joint, corresponding to the outer surface of the bowl-shaped head in shape, and abutting the outer surface of the bowl-shaped head;

a collar formed on and extending downward from an inner top surface of the chamber of the ball joint, protruding from the opening of the ball joint, and surrounding the central post of the knob body; and a fixing plate formed on and extending downward from the inner top surface of the chamber of the ball joint, protruding from the opening of the ball joint, and mounted in the slot of the fixing seat, wherein the ball joint of the extending handle has multiple slits that are formed in the bottom of the ball joint and are arranged around the ball joint at angular intervals.

2. The handle assembly as claimed in claim 1, wherein the ball joint of the extending handle has a chamfer formed around an edge of the chamber.

3. The handle assembly as claimed in claim 2, wherein the ball joint of the extending handle has multiple abutting ribs formed on an inner surface of the chamber of the ball joint and abutting the top end of the outer surface of the bowl-shaped head.

4. The handle assembly as claimed in claim 3, wherein the slot of the fixing seat is spaced from the central post.

5. The handle assembly as claimed in claim 4, wherein a connecting rib is formed between and connecting the collar and the fixing plate, and the fixing seat has a notch formed in the fixing seat at a position corresponding to the connecting rib.

6. The handle assembly as claimed in claim 5, wherein the handle body of the extending handle has a cushion mounted around the handle body.

7. The handle assembly as claimed in claim 4, wherein the handle body of the extending handle has a cushion mounted around the handle body.

8. The handle assembly as claimed in claim 3, wherein the fixing plate is formed as a slice.

9. The handle assembly as claimed in claim 8, wherein the handle body of the extending handle has a cushion mounted around the handle body.

10. The handle assembly as claimed in claim 3, wherein the handle body of the extending handle has a cushion mounted around the handle body.

11. The handle assembly as claimed in claim 2, wherein the handle body of the extending handle has a cushion mounted around the handle body.

12. The handle assembly as claimed in claim 1, wherein the handle body of the extending handle has a cushion mounted around the handle body.

* * * * *